United States Patent [19]

Pate et al.

[11] Patent Number: 5,016,517

[45] Date of Patent: May 21, 1991

[54] LIQUID PROPELLANT GUN

[75] Inventors: Robert A. Pate, Pittsfield, Mass.; Alma J. Pate, Provo, Utah

[73] Assignee: General Electric Company, Pittsfield, Mass.

[21] Appl. No.: 456,417

[22] Filed: Dec. 26, 1989

[51] Int. Cl.[5] ..... F41A 1/04

[52] U.S. Cl. ..... 89/7

[58] Field of Search ..... 89/7

[56] References Cited

U.S. PATENT DOCUMENTS 3,426,534 2/1969 Murphy .

4,023,463 5/1977 Tassie ..... 89/7

4,160,405 7/1979 Ayler et al. ..... 89/7

4,269,107 5/1981 Campbell ..... 89/7

4,478,128 10/1984 Black et al. ..... 89/7

4,523,508 6/1985 Mayer et al. ..... 89/7

4,586,422 5/1986 Magoon ..... 89/7

*Primary Examiner*—David H. Brown

*Attorney, Agent, or Firm*—Bailin L. Kuch

[57] ABSTRACT

This invention provides a gun having a combustion chamber (combustor) which is filled with a charge of monopropellant or bi-propellant to less than full volume. (e.g. 30 to 90%) prior to ignition thereof. which is ignited with a tangential flow of ignition gas from the side or rear to establish the desired pattern of combustion gas in the charge.

9 Claims, 4 Drawing Sheets

LIQUID PROPELLANT GUN

BACKGROUND OF THE INVENTION

1. Field of the Invention

The invention relates to guns utilizing a charge of liquid propellant which is bulk loaded into the combustion chamber of the gun. Control of the combustion process throughout the ballistic cycle is achieved by using charge position, charge loading density, chamber geometric configuration, propellant fill procedure, and igniter action to establish the desired hydrodynamic flow patterns which can couple properly with the combustion process.

2Prior Art

Classical bulk loaded liquid propellant guns are nearly 100 percent fully loaded by volume with a propellant which is quite incompressible. A pyrotechnic igniter located near the breech end of the charge is used to initiate the combustion process. The ballistic cycle proceeds as follows:

Single or multiple hot gaseous jets spray from the igniter. The liquid pressure rises very sharply with the mass addition from the igniter because of the non-compliant liquid. Even though very little combustion has occured, the high pressure caused by the igniter is sufficient to start projectile motion.

As the projectile moves, more volume is available for the combusting gases to expand into and the pressure drops because the amount of combustion established is not sufficient to maintain pressure while the projectile is moving. As the projectile moves down the tube, the light combustion gases in the breech accelerate the heavy liquid down the tube. This is an unstable flow condition and has been named the Rayleigh-Taylor instability. The light gases which can be accelerated down the tube more easily than the heavy liquid, try to achieve stability by changing places with the liquid. Multiple gas fingers penetrate into the liquid. As a hydrodynamic boundary layer is established in the tube, the penetrating gas fingers coalesce into a single central gas column which has been named a Taylor cavity. Throughout the Taylor cavity penetration process, the pressure continues to drop because insufficient combustion is occuring to maintain pressure with the volume expansion caused by projectile motion. After the Taylor cavity has penetrated to the base of the projectile, the liquid forms an annulus lining the tube wall and a gas core is established between the breech and the projectile. After penetration, the liquid is no longer accelerated at the same rate down the tube but rather the gases try to vent rapidly out the central core. Very high relative velocities are achieved between the gas core and the liquid annulus. This results in another classical flow phenomenon known as the "Kelvin-Helmholtz shear-layer instability". The disparate fluid velocities cause surface waves which result in droplets being stripped from the liquid surface and being entrained into the gas core. This mechanism of surface area augmentation is primarily responsible for achieving the high burn rates needed for successful ballistic performance. At the time the Taylor cavity penetrates to the projectile base, only about five percent of the liquid propellant has been burned. Only after complete penetration has occured and the Helmholtz augment combustion is established does the pressure again begin to rise. This Helmholtz augmented burning continues until the liquid propellant charge is completely consumed by combustion.

While some control over the ignition process is possible, very little subsequent control is available for the Taylor cavity penetration and the Helmholtz burning. Fortunately these processes are somewhat self-controlling, as attested to by the thousands of successful bulk firings. As the projectile moves forwardly more rapidly, generating additional volume there behind, the Taylor cavity is able to penetrate faster and the shear-layer interface is able to elongate, thus greatly increasing the burn rate. Likewise, if the projectile moves forwardly more slowly, the burn rate stays at a modest level because the Taylor and Helmholtz mechanisms do not augment the reaction area as rapidly. Thus, high burn rates occur when they are needed and not when they cannot be tolerated.

Historically, the performance of bulk loaded firing has been plagued by a lack of sufficient controllability and repeatability. The most significant single opinion of prior researchers is that the non-repeatable ignition has been the primary cause of the non-repeatable muzzle velocity. Other causes for failure include excessively fine mixing, improper loading, questionable propellant composition, previously compromised materials, and delayed ignition. None of these causes is inherent to the bulk liquid propellant combustion process.

Examples of bulk loaded liquid propellant guns are found in U.S. Pat. No. 4,478,128, issued Oct. 23, 1984 to W. L. Black et al, and U.S. Pat. No. 4,160,405, issued July 10, 1979 to S. E. Ayler et al.

U.S. Pat. No. 4,269,107, issued May 26, 1981 to J. Campbell, Jr. shows a regenerative liquid propellant gun having a storage and pumping chamber aft of the piston and a combustion chamber forward of the piston. The inlets for propellant to the storage chamber are at an angle to the gun axis to provide a swirling flow which forces trapped bubbles out through a vent from the storage chamber.

U.S. Pat. No. 3,426,534, issued Feb. 11, 1969 to D. F. Murphy shows a rocket having a combustion chamber which is fed by a circular control chamber which has tangential fluid and gas inlets.

SUMMARY OF THE INVENTION

An object of this invention is to control combustion in the combustion chamber and gun tube by inducing hydrodynamic flow patterns compatible with the combustion characteristics of the propellant.

Another object is to provide repeatable ignition process to the main charge by means of re-circulation of the kernel (combusting volume) of ignition gas in the hot ignition zone of the liquid propellant charge.

Yet another object is to provide lower required ignition pressures in the charge by promoting chemical and thermal feedback of reactive species in the ignition zone.

Still another object is to provide free volume (ullage) to act as a gas accumulator to buffer pressure rises and extend blow-down of ignited products through the liquid charge.

Still another object is to prevent premature shot start of the projectile.

Still another object is to utilize the propellant fill procedure to establish desired propellant configuration (position and motion) prior to ignition.

A feature of this invention is the provision of a gun having a combustion chamber (combustor) which is filled with a charge of monopropellant or bi-propellant to less than full volume, (e.g. 30 to 90%) prior to ignition thereof, which is ignited with a tangential flow of ignition gas from the side or rear to establish the desired pattern of combustion gas in the charge.

BRIEF DESCRIPTION OF THE DRAWING

These and other objects, advantages and features of the invention will be apparent from the following specifications thereof taken in conjunction with the accompanying drawing in which.

DESCRIPTION OF THE INVENTION

The Hydrodynamically Stabilized Combustor (HDSC) of this invention solves the problem of non-repeatable muzzle velocity which has plagued classical bulk liquid propellant guns by incorporating the following:

Gas Accumulation/Increased Ullage—Ullage uncouples the projectile shot start from the initial igniter action, permitting sufficient combustion to be initiated to sustain a desirable pressure rise. The ullage also buffers the pressure history yielding several beneficial results.

Tangential Igniter Jet—The tangential orientation of the igniter promotes the thermal and chemical feedback of energy and reactive species in the ignition zone which is necessary for prompt and repeatable ignition in a low pressure/low loading density environment.

Swirl During Taylor Cavity Penetration—Swirl causes a single Taylor cavity to be formed very rapidly which is larger and penetrates more rapidly. Swirl also causes an increased burn rate during the early cavity penetration phase by causing Helmholtz surface area augmentation in the rotational direction.

Swirl During Helmholtz Burning—Swirl of the liquid annulus induces a radial acceleration which partially stabilizes the liquid surface and inhibits Helmholtz surface area augmentation.

Dynamic Fill—A rapid tangential fill option would configure the propellant initially in an annulus lining the chamber wall. This would obviate the Taylor Cavity penetration and permit direct formation of a burning Helmholtz annulus.

Several methods are possible to achieve the desired gas accumulator effect and propellant configuration produced by the increased ullage. Four possible configurations include the following:

1. a collapsible/disposable volume displacer, e.g. a volume of styrofoam;
2. a mechanical piston or valve separating the ullage from the charge;
3. a dynamic fill process using rotational momentum to position the charge and ullage; and
4. a static fill process where the igniter and the combustion geometry establish the desired flow.

The propellant which has been used most extensively in this and related developments is a monopropellant consisting of hydroxylammonium nitrate 60.8% as the oxidizer and triethanolammonium nitrate 19.2% as the fuel in a 20% water solution which has been given the name LGP 1846.

Figure 1:
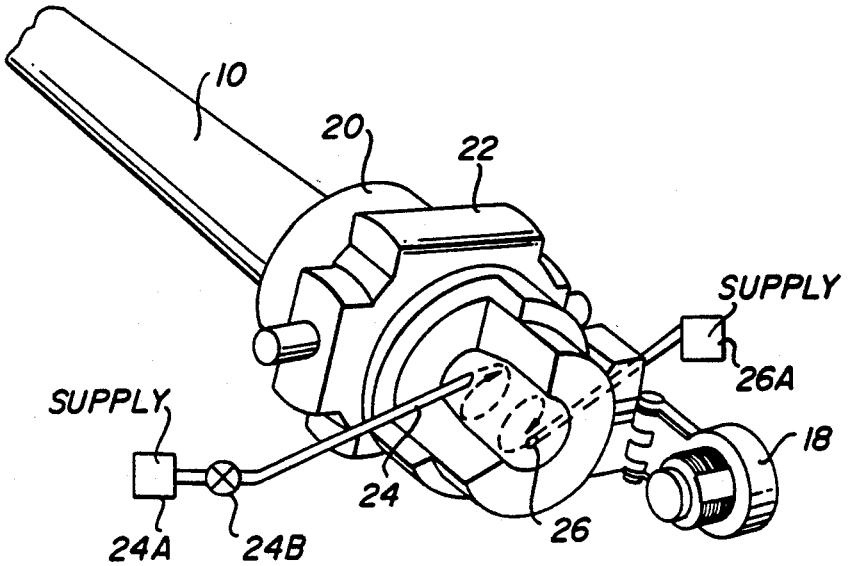
FIG. 1 shows a bulk loaded liquid propellant gun having a hydrodynamically stabilized combustor embodying the invention.
Figure 2:
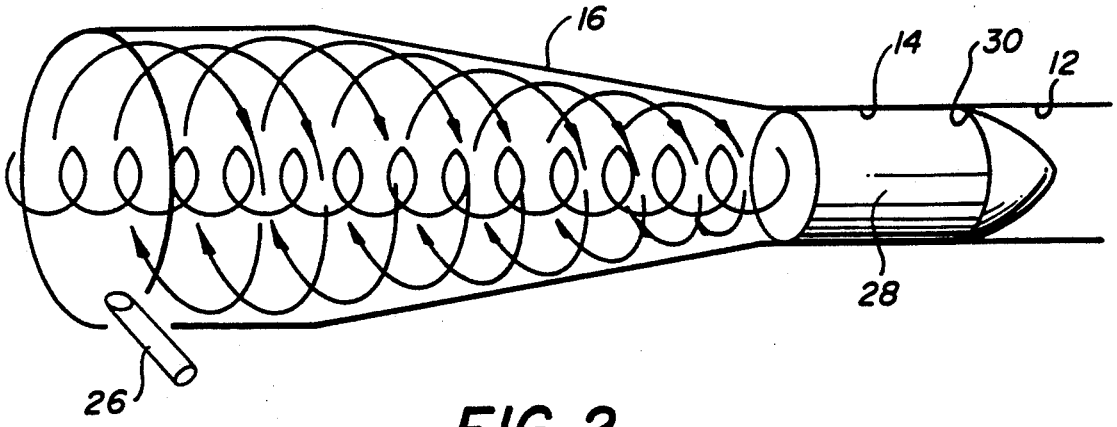
FIG. 2 is a diagram in perspective showing the flows of liquid propellant and ignition gas in the combustor.

A liquid propellant gun embodying the HDSC is shown in FIGS. 1 and 2. The gun includes a gun barrel (or tube) 10 having a forward firing bore 12, an intermediate, projectile receiving chamber 14, and an aft combustion chamber 16. The combustion chamber 16 can be of bulbous shape having a substantially aftmost diameter which is larger than the diameter of the projectile receiving chamber 14, and reduces forwardly progressively to the diameter of the projectile receiving chamber. The aft end of the combustion chamber is closed by a conventional breech mechanism 18. The gun barrel is mounted in a recoil cylinder 20. The recoil cylinder is supported by a conventional mount mechanism 22. A first chordal inlet 24 leads into the forward portion of the combustion chamber to provide a flow of liquid propellant on a tangent to the inner wall of the combustion chamber. The inlet 24 is fed by a supply 24A of liquid propellant under pressure through a valve 24B. This valve may be embodied as a powered metering cylinder. A second chordal inlet 26, serving as an ignitor, leads into the aft portion of the combustion chamber to provide a flow of ignition gas on a tangent to the inner wall of the combustion chamber. The radial position of the igniter is dependent on the application and the fraction of the charge that is desirable to have involved in the early portion of the ballistic cycle.

The inlet 26 is fed by a supply 26A of high temperature combustion gas, e.g., such as is shown in U.S. Pat. No. 4,231,282, issued Nov. 4, 1980 to E. Ashley. A conventional projectile 28 is loaded into the chamber 14 and halted by the conventional forcing cone 30 transition in diameter between the bore 12 and the chamber 14.

A schematic of the fluid flow is shown in FIG. 2. The combustion chamber 16 is initially tangentially filled for the dynamic fill option by the inlet 24 from the supply 24A to approximately 70% loading by volume with liquid propellant, leaving an initial gas ullage of 30%. The fill system injects liquid propellant tangentially to develop a cyclonic flow pattern which centrifuges the liquid propellant about the longitudinal axis of the gun and causes the entrained ullage gas to migrate toward the longitudinal axis. Thus an interface between the gas and the liquid exists even before the igniter gases enter the system. The igniter is also fired tangentially, by the inlet 26 from the supply 26A, into the combustion chamber near the breech, causing ignition gas to circulate circumferentially in the breech end of the combustion chamber and contribute to the cyclonic motion in the propellant. This causes a mixture of entrained fuel combustion by-product gas and igniter by-product gas and ignition gas to pass the igniter inlet 26 several times which promotes ignition. Ignition of the liquid propellant occurs at the breech end when the igniter induced chamber pressure reaches about 3000 psi; projectile motion forwardly past the forcing cone begins at about 5000 psi. The combustion gas will follow the projectile thereby causing liquid-gas surface area augmentation (by shear-generated instability) and the required increase in burn rate.

The accelerating fluid field will form a burning region similar to a Taylor cavity which will penetrate to the base of the projectile. After this penetration by the Taylor cavity has occurred, Kelvin-Helmholtz instability on the remaining annulus of liquid propellant will augment the burning surface area until the charge is consumed. Depending on the loading density and fill process, the Helmholtz augmented burning may be established directly without Taylor cavity penetration.

Figure 3:
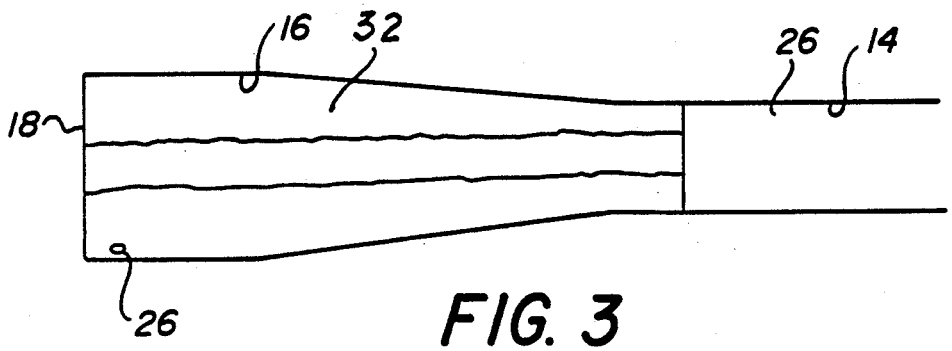
FIG. 3 is a diagram showing the liquid gas interface in the combustor after dynamic filling and before ignition for one possible configuration.

The critical phases of the HDSC ballistic cycle include (i) propellant fill, (ii) ignition, and (iii) combustion. Each of these phases is discussed in more detail below:

Propellant Fill. Two design criteria relevant to the HDSC are maintenance of a large ullage at fill (approximately 30% by volume at standard temperature and pressure) and arrangement of propellant injection to induce a cyclonic flow pattern in the chamber. The propellant mass 32 will retain its angular momentum for many seconds after the fill procedure has been completed. FIG. 3 shows the system containing a liquid annulus after fill. Advantageously, the fill orifice and the powered metering cylinder are adjusted to complete fill in less than one second. If more of a traveling charge effect is desired, a complete volumetric fill of the region nearer the projectile is preferred.

Ignition. The ignition process begins when hot gases 34 from the external igniter supply 26A are tangentially injected by inlet 26 at the breech end of the combustion chamber 16. An essential part of the HDSC ignition is the increased residence time of the liquid propellant in the vicinity of the ignition source 26, which is due to the swirling of the circumferentially injected igniter gases. Since the momentum of the igniter jet of gases is confined to a planar region in the breech, perpendicular to the gun axis, the gases must change direction as the pressure rises before an axial momentum component can be established in the gas flow. In the interim, the igniter jet will entrain some of the propellant in the re-circulation zone. (The parameters, which determine the magnitude of the fraction of the charge which will mix with the igniter gases, include igniter area, velocity, duration and breech configuration.)

Figure 4:
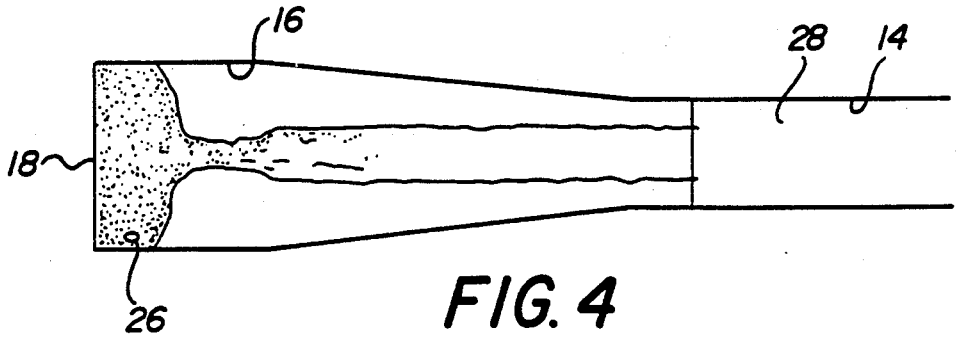
FIG. 4 is a diagram showing the liquid gas interface in the combustor after ignition.

The momentum of the flow of igniter gases will tend to confine the igniter jet against the wall; high density liquid droplets will also be accelerated toward the wall. Thus there will be continual mixing in the breech re-circulation zone as shown in FIG. 4 which will result in transfer of momentum and heat.

Energy is transferred from the igniter gases to the propellant, increasing the temperature of the propellant. The propellant is more easily ignited as water vapor begins to be driven off at approximately 100° C. The propellant begins to "fizz" burn at approximately 124° C. This fizz mode consists of bond breaking and gasification of only the HAN component of the propellant. The gasification of HAN does not increase the chamber pressure significantly; the pressure rise is due principally to the igniter gases.

Figure 5:
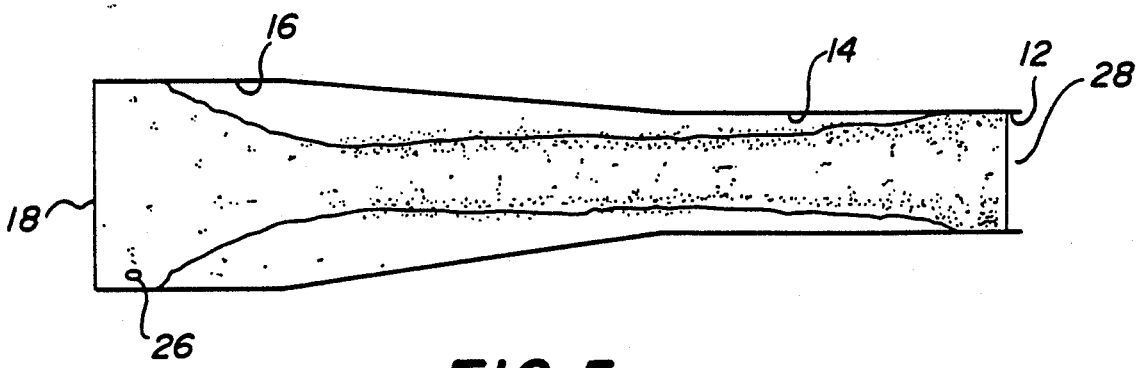
FIG. 5 is a diagram showing the liquid gas interface in the combustor during Helmholtz augmented combustion.

Combustion. As the pressure rises to about 3000 psi (210.9 kg/cm$^2$), the concentration of the reactive species liberated in the fizz-burn is sufficient to sustain reaction with the fuel component (TEAN) of the monopropellant. This is the fizz-burn to flame-burn transition. At this time, the pressure will rise very rapidly. Since the linear burn rate is only about one foot per second (30.5 cm/sec), the total burn rate can be increased only by increasing the surface area. At this point, the Helmholtz shear instability greatly augments the liquid surface area available for burning as shown in FIG. 5. The projectile is then dislodged past the forcing cone at approximately 5000 psi (351.5 kg/cm$^2$). As this shot start pressure is achieved, the combusting gases migrate rapidly through the liquid annulus as is characteristic of conventional bulk loaded guns.

Figure 6:
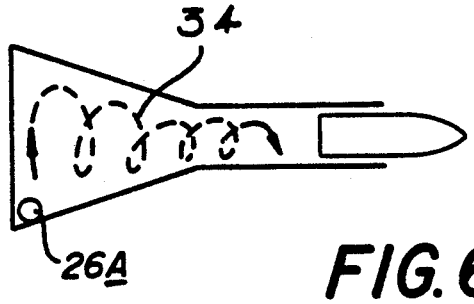
FIG. 6 is a diagram showing cyclonic flow and a tangential ignitor as in FIG. 2.
Figure 7:
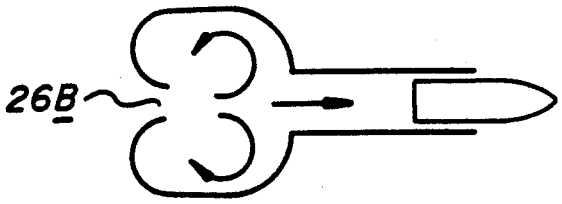
FIG. 7 is a diagram showing a central ignitor and a toroidal flow.
Figure 8:
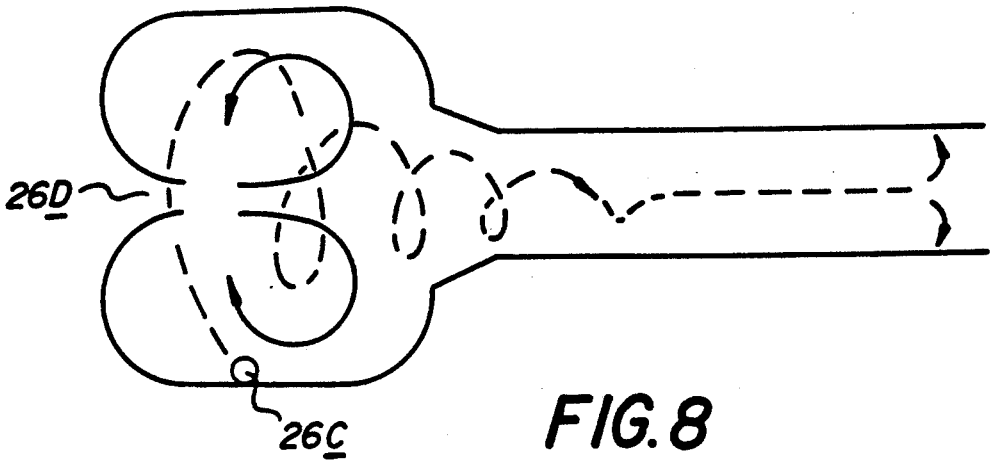
FIG. 8 is a diagram showing a combination of flows.

Other flow patterns can be utilized. The baseline, shown in FIG. 6, is identical to that shown in FIG. 2, is the cyclonic or swirl, utilizes a tangential igniter 26A that promotes flow about the central axis and develops a gas cone. The second, shown in FIG. 7, utilizes a central igniter 26B that causes a toroidal circulation that will tend to propel heavy droplets down the combustion chamber forward portion. The third, shown in FIG. 8, utilizes a combination of the first two flow patterns with ignitors 26C and 26D plus a frictional hydrodynamic boundary layer to retard the flow at the walls of the combustion chamber forward portion and permits a central core, initially of propellant and later of gas, to flow rapidly forward with the base of the projectile to create the desired coupling with the combustion process.

Figure 9:
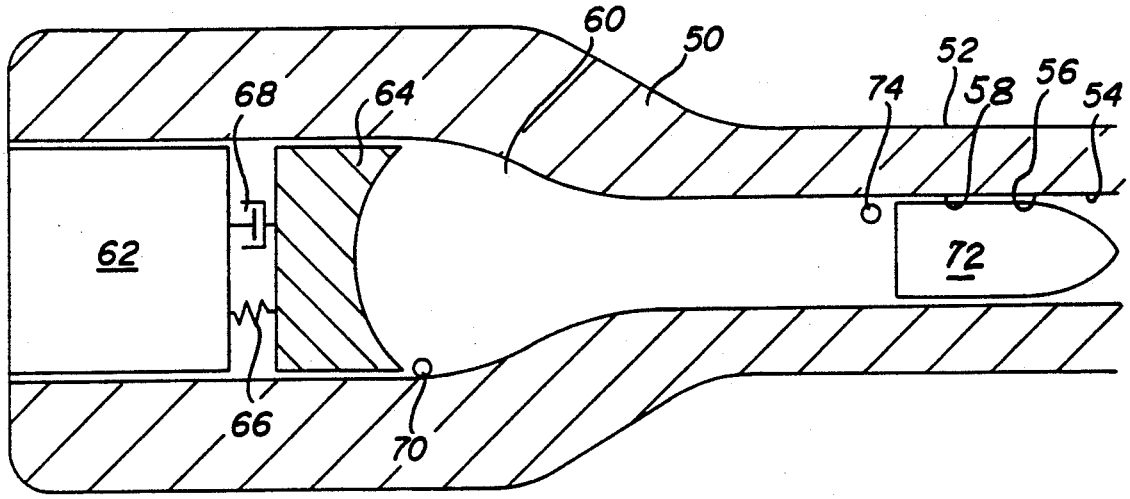
FIG. 9 shows another embodiment of a bulk loaded liquid propellant gun which automatically develops a loading density of less than 100%.

A system which registers the propellant forward, yet provides less than 100% loading density, is shown in FIG. 9. The housing 50 includes a gun barrel 52, a firing bore 54, a forcing cone 56, a projectile receiving portion 58, a combustion chamber 60 and a breech closure 62. A piston 64 is disposed within the chamber 60 and biases forwardly a weak spring 66 with a damper (dash-pot) 68. An igniter inlet 70 leads into the combustion chamber forward of the piston 64 at its forwardmost travel. A projectile 72 is inserted into the portion 58 until it lodges against the forcing cone 56. With the piston forward, the combustion chamber is fully loaded with propellant from inlet 74 just aft of the base of the projectile. The igniter gas flow will first push the piston back against the weak spring while the swirl is being established. Only after the piston bottoms will the propellant be pressurized significantly. Thus when the propellant is ignited, all of the liquid propellant is in the forward portion of the combustion chamber and the igniter gas has displaced the piston to enlarge the volume of the combustion chamber to provide a loading density which is significantly less than 100%. If the displacement volume provided by the piston is 30% of the final volume of the chamber, the loading density is 70%. This approach has the additional advantage of pre-positioning the propellant immediately aft of the projectile in a favorable configuration for a traveling charge effect wherein the remainder of the liquid charge moves forwardly with the projectile.

Figure 10:
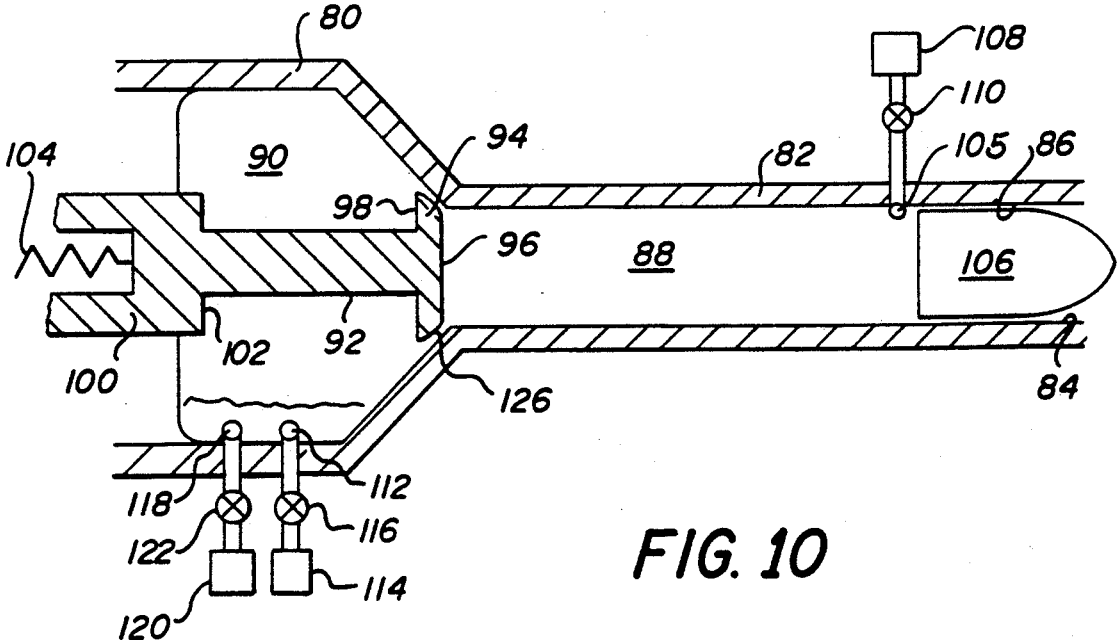
FIG. 10 shows another embodiment of a bulk loaded liquid propellant gun which uses two chambers separated by a piston/valve.

FIG. 10 shows another approach to achieve the same ballistic functions. The housing 80 includes a gun barrel portion 82, a firing bore 84, a forcing cone 86, a forward combustion chamber 88 and an aft combustion chamber 90. A piston valve 92 has a truncated conical head portion 94 having a forward circular face 96 and an aft annular face 98, and a base portion 100 having a forward annular face 102. A spring 104 biases the piston forwardly so that the piston head 94 closes off the forward chamber 88 from the aft chamber 90. The face 96 has the largest area, the face 98 has less area, and the face 102 has the least area. A chordal inlet 105 for liquid propellant is provided in the forward chamber, aft of the base of the projectile 106 which is positioned in the bore 84 by the forcing cone 86. A pressurized supply 108 of liquid propellant, via a valve 110, fully fills the forward chamber. A chordal inlet 112 for liquid propellant is provided in the aft chamber. A pressurized supply 114 of liquid propellant, via a valve 116, provides a small charge of liquid propellant, leaving a large ullage volume in the aft chamber. A chordal inlet 118 for ignition gas is provided in the aft part of the aft chamber and is coupled to a source of ignition gas 120 through a valve 122. When ignition gas is initially supplied into the aft chamber, the forward chamber is sealed off by the piston head 94 and the ignition gas recirculates in the high ullage, low propellant density volume. As pressure builds up, the pressure differential between the forward faces 96 and 102 and the aft face 98 overcomes the bias of the spring to move the piston aftwardly. An annular opening 126 is thus provided for the combustion gas into the column of propellant in the forward chamber.

What is claimed is:

1. A gun cycle for a liquid propellant gun having a combustion chamber comprising:

filling the chamber with a charge of monopropellant to a range of 30% through 90% of full volume, thereby providing a significant ullage volume.

2. A cycle according to claim 1 wherein:

said charge is injected onto a toroidal path adjacent the inner wall of the chamber.

3. A cycle according to claim 1 wherein:

said monopropellant filling is halted when said monopropellant occupies substantially 70% of said volume.

4. A cycle according to claim 1 wherein:

said charge is injected onto a tangential path adjacent the inner wall of the chamber.

5. A cycle according to claim 4 further comprising:

inputting a flow of ignition gas onto a tangential path adjacent the inner wall of the chamber.

6. A cycle according to claim 5 wherein:

said charge is injected at the forward end of said chamber; and said ignition gas is injected at the rearward end of said chamber.

7. A gun cycle for a liquid propellant gun having a combustion chamber comprising:

providing the chamber with a first volume capacity;

filling the chamber to the first volume capacity;

enlarging the chamber to a second volume capacity greater than the first volume capacity, the difference providing a significant ullage volume.

8. A cycle according to claim 7 wherein:

said enlarging of said chamber to said second volume is halted when said first volume is in the range of 30% to 90% of said second volume.

9. A cycle according to claim 7 wherein:

said enlarging of said chamber to said second volume is halted when said first volume is at substantially 70% of said second volume.

* * * * *